United States Patent [19]

Rhodes et al.

[11] Patent Number: 4,619,313

[45] Date of Patent: Oct. 28, 1986

[54] RADIATOR FRAME UNIT

[75] Inventors: Wayne A. Rhodes, Larray; Kenneth D. Harrington, Jackson, both of Tenn.

[73] Assignee: Touchstone Railway Supply & Mfg. Co., Inc., Jackson, Tenn.

[21] Appl. No.: 660,461

[22] Filed: Oct. 12, 1984

[51] Int. Cl.[4] ..... F28F 9/00

[52] U.S. Cl. ..... 165/67; 165/82; 165/149; 180/68.4

[58] Field of Search ..... 165/DIG. 9, 67, 81, 165/82, 149, 906; 180/68.4

[56] References Cited

U.S. PATENT DOCUMENTS

| | | | |
|---|---|---|---|
| 2,090,345 | 8/1937 | Coy | 165/82 |
| 2,932,489 | 4/1960 | Young | 165/149 |
| 3,165,151 | 1/1965 | Astrup et al. | 165/149 X |
| 3,627,035 | 12/1971 | Astrup | 165/149 X |
| 3,982,587 | 9/1976 | Tramontini | 165/149 |
| 4,140,177 | 2/1979 | Ivie, Sr. | 165/149 X |
| 4,230,176 | 10/1980 | Crews | 165/149 X |
| 4,465,126 | 8/1984 | Winterer | 165/149 X |

*Primary Examiner*—Albert W. Davis, Jr.
*Assistant Examiner*—Randolph A. Smith
*Attorney, Agent, or Firm*—Head, Johnson & Stevenson

[57] ABSTRACT

An improved frame assembly for holding radiator heat exchanger core units required for cooling engines such as the locomotive engine. There are specially designed side frames on each side of the cooling core with special push-pad units between the side rail and the core. The push-pads include fixed sections which are fixed with respect to the side frame and movable sections which are movable therewith to provide for unequal expansion of the side frame and the core.

13 Claims, 6 Drawing Figures

RADIATOR FRAME UNIT

BACKGROUND OF THE INVENTION

This invention relates to frames supporting cooling core units for radiators. Typically core units are formed of tubes which may be either flat or round which span the distance between a pair of header plates wherein the opposite ends of the tubes are bonded. The core unit has to be supported within side frames. The tubes are usually made of brass which has one coefficient of expansion and the side frame is usually made of high-quality steel which has a different coefficient of expansion.

It is an object of this invention to provide a frame for holding a cooling core which allows for the unequal expansion of the core unit and the frame unit and still has the strength required to maintain the core in the correct position.

SUMMARY OF THE INVENTION

This invention concerns a new system for maintaining cooling core units within a frame unit. The cooling core unit has a top, bottom, front, back and opposite sides or edges. The cooling core unit is held in a novel frame and may also be attached to adjacent core units to form a large cooling core assembly. A special side frame is provided for each cooling core unit. The side frame unit includes a side rail on opposite edges of the cooling core and about the same length as the length between the headers of the cooling core. The side frame unit also includes a push-pad between each side rail and the side of the cooling unit. Typically, the push-pad is a mostly flat metal sheet which is rather U-shaped in cross-section and has up-turning edges or lips to form U-channel supports. These push-pads fit over the edges or side of the cooling core unit. Each side of the cooling unit is held by a push-pad which is composed of two sections, an upper section and a lower section. One of the sections is fixed to the side rail and the other movable therewith along its length.

The outer ends of the push-pads are connected such as by welding to gussets. These gussets are U-shaped in cross section and have outer shoulders with holes therethrough which are parallel to the direction of the longitudinal dimension or axis of the side rails. The gusset is bolted to backing bars and the headers of the cooling core.

The movable section of the push-pads are held in position by means which typically are tie bars extending between the side rails with bearings contacting the turned up edges of the push-pad.

In this arrangement, the movable push-pad section moves as necessary to compensate for the difference in expansion of the cooling core and that of the side. The side rails are held together rigidly and thus, forms a strong support for both the fixed and movable sections of the push-pads which in turn strongly supports the cooling core unit. Further, the gusset and backing bar arrangement permits a plurality of the cooling cores to be connected end on end while still permitting compensation for the uneven expansion of the side rails and that of the cooling core units.

Various objects and a better understanding of the invention can be had from the following description taken in conjunction with the drawings.

DETAILED DESCRIPTION OF THE PREFERRED EMBODIMENT

Figure 1:
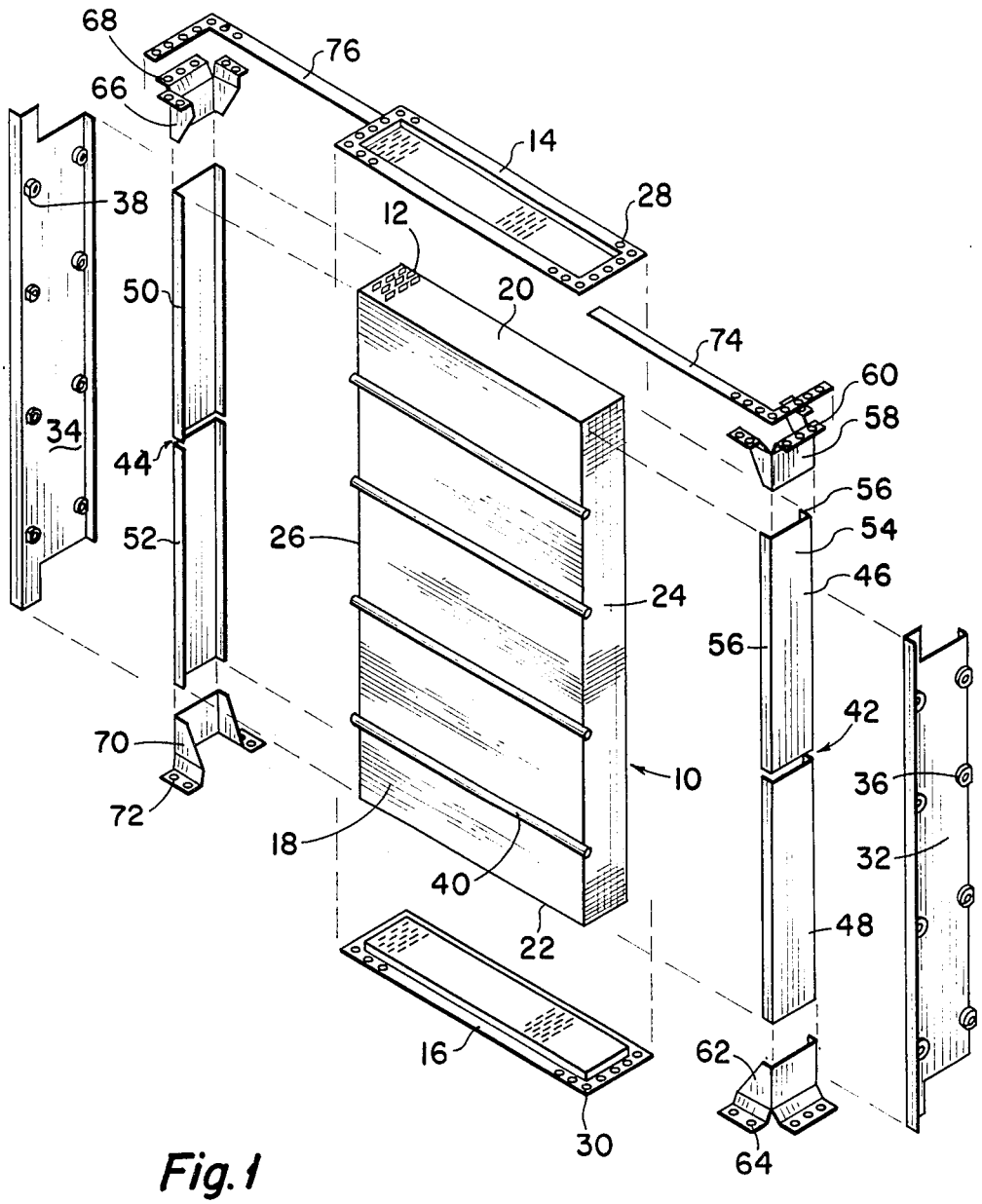
FIG. 1 is an exploded view of the principal components of our invention.

Attention is first directed to FIG. 1 which shows an exploded view of the main components of our invention. Shown thereon is a cooling core unit 10 which is formed of a plurality of tubes 12 which may be either flat or round and extend the distance between top header 14 and lower header 16. Cooling unit 10 can be a typical cooling unit which are used extensively in the industry. It is generally of a rectangular prism shape having a front 18 and back, a top 20, a bottom 22 and edges or sides 24 and 26. Headers 14 and 16 are provided with holes 28 and 30.

There is provided, a first side rail 32 and a second side rail 34, each having a plurality of bushings 36 and 38 respectively, which are fitted over the end of support or tie rods 40.

Spaced between the side rails and the core 10 are a first push-pad 42 and a second push-pad 44. Push-pad 42 has an upper movable section 46 and a lower fixed section 48. Likewise, push-pad 44 has an upper movable section 50 and a lower fixed section 52. Each push-pad section has a generally flat portion 54 with holding edges or lips 56 on either side thereof. It is between the holding edges 56 that the edges 24 and 26 of the cooling unit 10 is positioned. Fixed push-pad section 48 is attached such as by welding to side rail 32. Likewise, lower push-pad section 52 is attached to and preferably welded to side rail 34. Push-pad 42 is provided with an upper gusset 58 having holes 60. The number of holes shown in the drawing are to illustrate a method of assembly. The actual number of holes would be that required for good engineering practice. This gusset 58 is attached to and preferably welded to upper movable push-pad section 46. There is a lower gusset 62 having holes 64 which is welded to the lower end of fixed push-pad section 48. Likewise, gusset 66 having holes 68 is attached to movable push-pad section 50 and gusset 70 having holes 72 is likewise attached to fixed push-pad section 52. A backing bar having a first section 74 and a second section 76 with holes therethrough are provided for header 14 and gussets. These two sections make a rectangle mating with the header.

Figure 2:
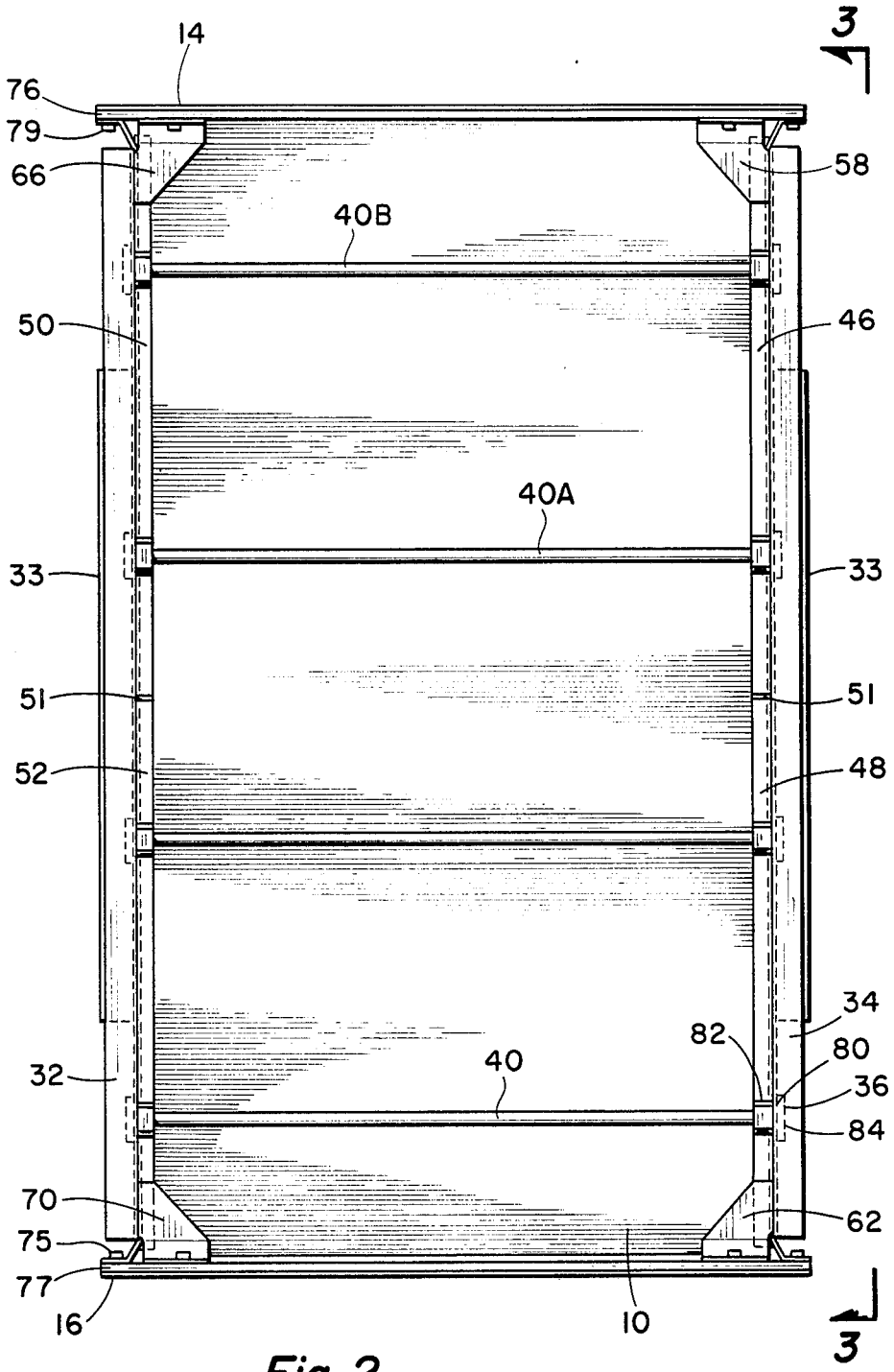
FIG. 2 is a full-face view of the components of FIG. 1 in assembled position.

Attention is next directed to FIG. 2 which shows an assembled unit of the components shown in FIG. 1. The corresponding parts in the two figures have the same referenced numerals. As can be seen, gussets 66, 58, 70 and 62 are welded to the outer ends respectively of push-pad section 50, 46, 48 and 52. Cooling core 10 is confined within the push-pads between the lips or upturned edges 56. Lower push-pad sections 52 and 48 are welded to side rails 34 and 32 respectively. There is a gap 51 between the movable sections and the fixed sections of the push-pads. Gussets 66 are attached by bolts 79 to backing bar 76 and header 14. Lower gusset 70 is likewise attached by bolts 75 to a backing bar 77 and header 16. Gussets 58 and 62 are similarly connected as are gussets 66 and 70, respectively.

Figure 3:
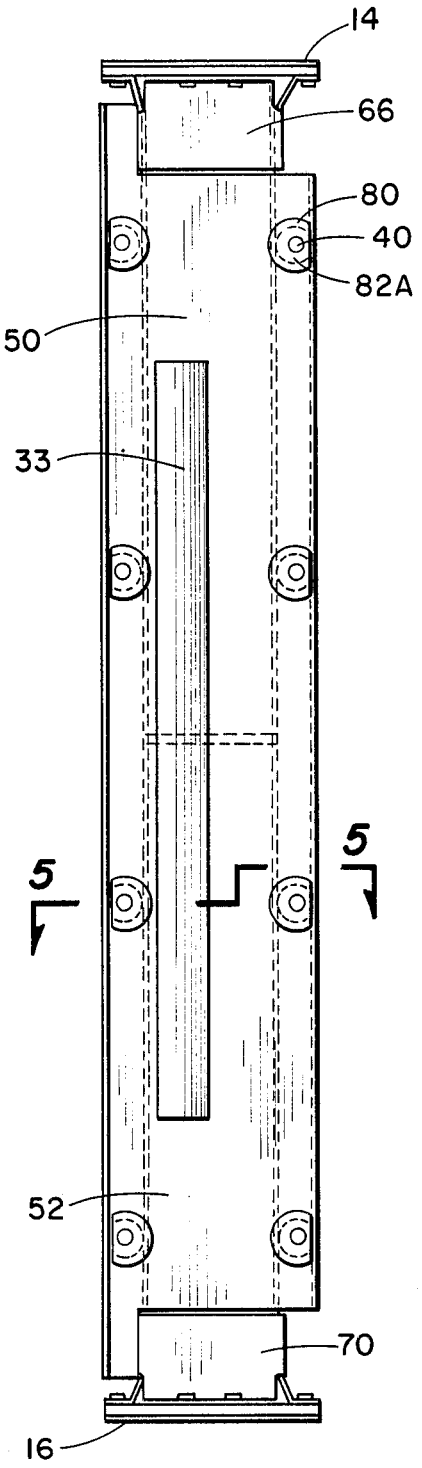
FIG. 3 is a view taken along the line 3—3 of FIG. 2.
Figure 4:
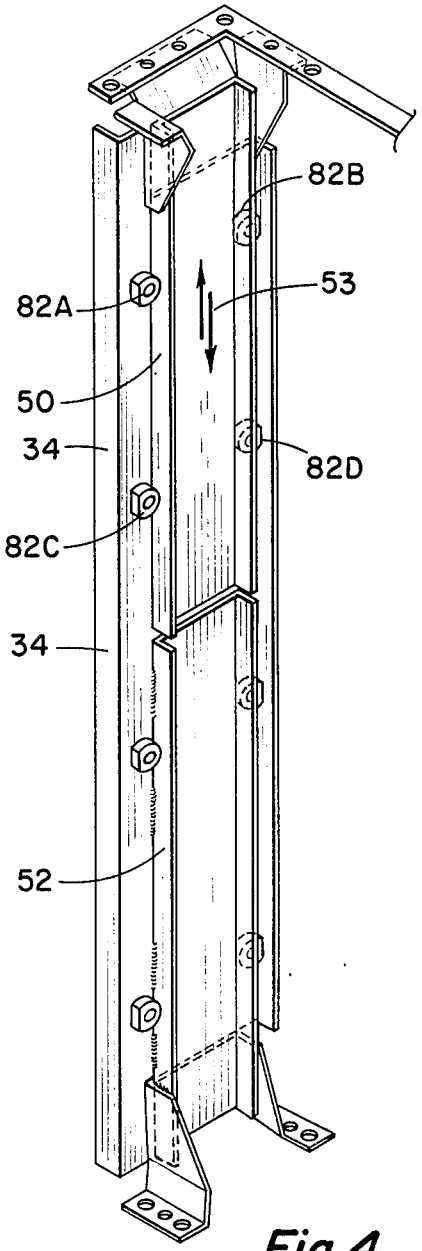
FIG. 4 illustrates the relationship of the fixed section and movable section of the push-pads with relation to the side rails.

Tie rods 40 extend from side rail 32 to side rail 34 and are exterior of the core 10. The end of each tie rod 40 is provided with a special type bushing 36 which has an enlarged head 80 and a bushing or bearing member 82. For assembly, there is a hole cut in the side rail 32 at the proper position to permit the bushing 82 to enter through it from the outside but small enough so that the enlarged head 80 will not pass therethrough. The external end of the tie rod 40 is fixed or attached to its enlarged portion 80 at 84. The bushings 36 are most important for the upper tie rods 40A and 40B which tie the side rails together in the area of the movable push-pads 46 and 50. There should be at least two bearing services 82 on each lip or edge 56 of removable section of the push-pads as clearly shown in FIGS. 3 and 4. As shown in FIG. 4, these bushings 82A, 82B, 82C and 82D maintains stability to push-pad 50 and confines the push-pad and permits only movement in a longitudinal direction as indicated by the arrows 53 with respect to the side rail 34. As shown in FIG. 4, the lower push-pad section 52 is welded to side rail 34. A spacer frame 33 is provided on the side rails to provide for proper spacing to avoid damage to the headers.

Figure 5:
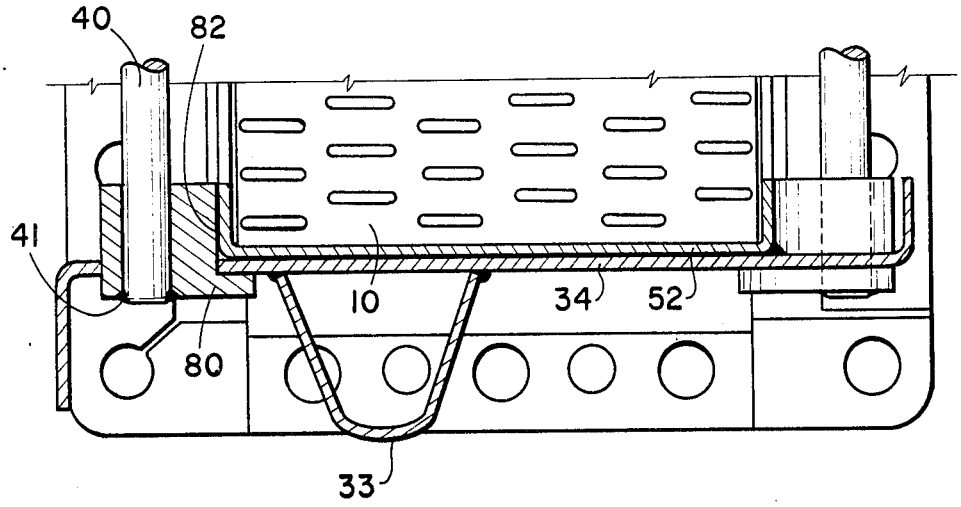
FIG. 5 is a view taken along the line 5—5 of FIG. 3.

FIG. 5 shows that the edge of cooling core 10 fits snuggly into the push-pad, which in this particular figure, is the fixed push-pad section 52 and is held firmly between side rail 34 and the side rail 32 (not shown in FIG. 5) by rods 40 which are welded or attached at 41 to head 80 of the bushing member 82 and are held quite tight therein. When the assembled unit is being transported, there is no movement between the core 10 and the side frame. However, when the assembled unit is put into operation, the heating of the unit will cause an unequal expansion between the steel of the side frame and the brass of the core 10 which generates a force of sufficient force to overcome friction. This expansion is compensated for by movement of the movable push-pad sections 50 and 46 which are not welded to the side rails 34 and 32. It will be noted that the side rail is connected to header 16 through gusset 70 and fixed push-pad section 52, but is not directly connected to upper header 14. Upper header 14 is connected to gusset 66 to movable push-pad section 50. The side rail is not rigidly attached between the headers 14 and 16, therefore, the difference in expansion of the cooling core unit between the headers and the expansion of the side rails can be accommodated by the movement of movable push-pad section 50 and 46 in this example.

Figure 6:
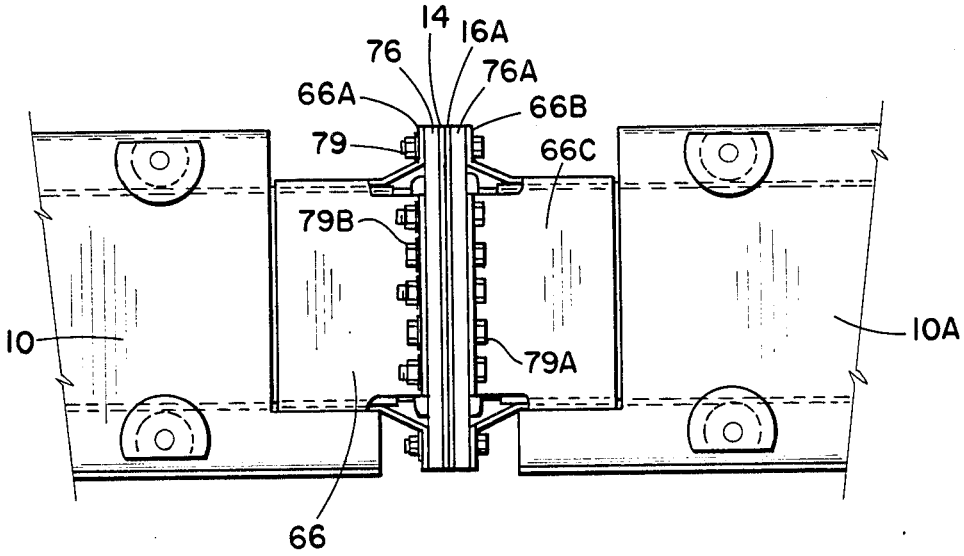
FIG. 6 illustrates the end-end attachment of two assembled cooling units.

Attention is next directed to FIG. 6 which illustrates two assembled cooling units. It shows how two similar core units 10 and 10A can be connected. Header 14 of the cooling unit just described and header 16A of a similar unit are abutted as shown in FIG. 6. There are bolts 79 extending through gusset lip 66A, backing bar 76, first header 14, second header 16A, second backing bar 76A, and second gusset lip 66B of gusset 66C. Bolts 79A for holding the two assembled cooling units together are also provided as indicated. The backing bar and gusset may be attached to the header by bolts 79B which extends into a threaded tap in the header. As many units as need to be mounted together can be satisfactorily connected using the system of our invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element is entitled.

What is claimed is:

1. A radiator assembly including:

a cooling core having two opposite sides;

a side rail on each side of said cooling core, each said side rail having an exterior side and an interior side;

a push-pad unit on each side of said core between said side rail and said cooling core, each said push-pad unit having a first section fixed to said side rail and a second section movable with respect to said side rail, said first section and said second section being in non-overlapping relationship;

means to hold said side rails together.

2. A radiator assembly as defined in claim 1 in which said means to hold includes a plurality of parallel tie rods spaced apart and extending from the exterior side of one side rail to the exterior side of the other and including bearing means supported by said tie rod adjacent the interior side of said side rail for contacting said push-pad.

3. A radiator assembly as defined in claim 1 including a gusset welded to the movable section and a gusset welded to said fixed section of said push-pad at the exterior ends thereof, said gusset having a flared section having a lip which is perpendicular to the longitudinal axis of said push-pad and having holes extending therethrough.

4. A radiator assembly as defined in claim 1 in which each said push-pad is a flat strip of metal having both sides turned up to form a lip in either side for receiving and holding the edges of said core.

5. A core assembly as defined in claim 4 in which the exterior of each lip of said movable push-pad section is in contact with at least two bushings for each said lip.

6. An assembly for holding a cooling core which includes:

a first side frame and a second side frame;

a first and a second push-pad, each being of lesser length than either of said first and second side frames, each said push-pad having a flat section with upturned lips pointing in the same direction and forming a U-channel support, each said push-pad having a movable section and a fixed section in a nonoverlapping relation, said fixed section being rigidly attached to said side frame, connecting means for holding said side frames and said push-pads together.

7. A core holder as defined in claim 6 in which there is a gap between said movable section and said fixed section of each said push-pad and a gusset rigidly attached to the non-gap end of said sections, each said gusset being U-shaped in cross section and including two lips with holes therein.

8. A radiator assembly including:

a cooling core having two opposite sides and a length;

a unitary side rail on each side of said cooling core and extending essentially the full length of said core;

a push-pad unit on each side of said core between said side rail and said core, each said push-pad unit having a flat section with upturned lips pointed in the same direction and forming a U-channel support for receiving said cooling core, each said push-pad having a movable section and a fixed section in a non-overlapping relation, said fixed section being rigidly attached to said side rail;

connecting means for holding said side rails and said push-pads together.

9. A radiator assembly as defined in claim 8 in which there is a gap between said movable section and said fixed section and a gusset rigidly attached to the non-gap end of said sections, each said gusset being U-shaped in cross-section and including two lips with holes therein.

10. A radiator assembly as defined in claim 8 in which the length of a push-pad unit is less than the length of said side rail.

11. A radiator assembly including;

a cooling core having two opposite sides;

a side rail on each side of said cooling core, each said side rail having an exterior side and an interior side;

a push-pad unit on each side of said core between said side rail and said cooling core, each said push-pad unit having a first section fixed to said side rail and a second section movable with respect to said side rail;

a gussett welded to the movable section and a gussett welded to said fixed section of said push-pad unit at the exterior ends thereof, said gusset having a flared section having a lip which is perpendicular to the longitudinal axis of said push-pad and having holes extending therethrough;

means to hold said side rails together.

12. A radiator assembly as defined in claim 11 including a header on said core, a backing bar between said gusset and said header, said backing bar attached to said gusset by a bolt extending into a tap in said header which does not extend all the way through and bolts attaching said header and backing bar to said gusset.

13. A radiator assembly including:

a cooling core having two opposite sides;

a side rail on each side of said cooling core, each said side rail having an exterior side and an interior side;

a push-pad unit on each side of said core between said side rail and said cooling core, each said push-pad unit having a first section fixed to said side rail and a second section movable with respect to said side rail;

each said push-pad is a flat strip of metal having both sides turned up to form a lip in either side for receiving and holding the edges of said core;

means to hold said side rails together.

* * * * *